US008961700B2

(12) United States Patent
Moragas Arjant et al.

(10) Patent No.: US 8,961,700 B2
(45) Date of Patent: Feb. 24, 2015

(54) DILUTABLE SURFACTANT COMPOSITION

(71) Applicant: KAO Corporation S.A., Barcelona (ES)

(72) Inventors: Elisabet Moragas Arjant, Barcelona (ES); Blanca Nogues Lopez, Barcelona (ES)

(73) Assignee: KAO Corporation S.A., Barcelona (ES)

( * ) Notice: Subject to any disclaimer, the term of this patent is extended or adjusted under 35 U.S.C. 154(b) by 0 days.

(21) Appl. No.: 13/900,302

(22) Filed: May 22, 2013

(65) Prior Publication Data

US 2013/0316939 A1 Nov. 28, 2013

(30) Foreign Application Priority Data

May 22, 2012 (EP) ..... 12382189

(51) Int. Cl.

| | |
|---|---|
| ***B08B 3/04*** | (2006.01) |
| ***C11D 1/29*** | (2006.01) |
| ***C11D 1/72*** | (2006.01) |
| ***C11D 1/83*** | (2006.01) |
| ***C11D 1/88*** | (2006.01) |
| ***C11D 1/94*** | (2006.01) |
| ***C11D 3/04*** | (2006.01) |
| ***C11D 17/00*** | (2006.01) |
| *C11D 1/14* | (2006.01) |
| *C11D 1/74* | (2006.01) |
| *C11D 1/75* | (2006.01) |
| *C11D 1/90* | (2006.01) |

(52) U.S. Cl.

CPC .. *C11D 1/94* (2013.01); *C11D 1/83* (2013.01); *C11D 3/046* (2013.01); *C11D 17/003* (2013.01); *C11D 1/146* (2013.01); *C11D 1/29* (2013.01); *C11D 1/74* (2013.01); *C11D 1/75* (2013.01); *C11D 1/88* (2013.01); *C11D 1/90* (2013.01)

USPC ..... 134/25.2; 134/25.3; 134/39; 134/42; 510/421; 510/426; 510/492; 510/505; 510/524; 510/535

(58) Field of Classification Search

CPC ..... B08B 3/04; C11D 1/29; C11D 1/72; C11D 1/83; C11D 1/88; C11D 3/046; C11D 3/2093; C11D 7/266

USPC ..... 510/421, 426, 492, 505, 524, 535; 134/25.2, 25.3, 39, 42

See application file for complete search history.

(56) References Cited

U.S. PATENT DOCUMENTS

| | | | | |
|---|---|---|---|---|
| 5,549,840 | A * | 8/1996 | Mondin et al. | 510/365 |
| 5,922,664 | A | 7/1999 | Cao et al. | |
| 6,265,373 | B1 * | 7/2001 | Oses et al. | 510/506 |
| 2003/0050200 | A1 | 3/2003 | Chen | |

FOREIGN PATENT DOCUMENTS

| | | |
|---|---|---|
| EP | 1045021 | 10/2000 |

* cited by examiner

*Primary Examiner* — Brian P Mruk

(74) *Attorney, Agent, or Firm* — Barnes & Thornburg LLP

(57) ABSTRACT

Disclosed are aqueous, concentrated dilutable liquid cleaning compositions comprising one or more anionic surfactants, one or more non-ionic surfactants, and an electrolyte, preferably in combination with one or more amphoteric surfactants, having a total active matter higher than 45 wt % based on the sum of the surfactants above that exhibit a controllable viscosity profile that is satisfactory to the consumer while being easy to dilute, providing fast enough a diluted, a medium diluted or a highly diluted cleaning composition.

16 Claims, No Drawings

DILUTABLE SURFACTANT COMPOSITION

CROSS-REFERENCE TO RELATED APPLICATION

This application claims priority to EP Application Serial No. 12382189.4 filed May 22, 2012, the disclosure of which is hereby incorporated herein by reference

FIELD OF THE INVENTION

The present invention relates to aqueous concentrated surfactant compositions suitable to be diluted by consumer prior to use.

The present invention provides a composition comprising a surfactant basis comprising one or more anionic surfactants, one or more non-ionic surfactants, and one electrolyte, preferably in combination with one or more amphoteric surfactants and/or a solvent, and having a total active matter higher than 45 wt % based on the sum of the surfactants above that, upon dilution with water, exhibit a viscosity higher than the concentrate, adapted for preparing liquid cleaning compositions ready to be used, particularly useful for dishwashing.

STATE OF THE ART

The industry is interested in finding solutions to produce more ecologic and more profitable cleaning products while satisfying the final consumer expectations and needs. One of the trends in this regard, specially relevant for home care, and in particular for dishwashing products, is the production of highly concentrated products to be diluted by the final consumer to those concentrations suitable for the final use. The commercialization of highly concentrated products instead of ready to use formulations has several advantages. For instance, the costs associated with packaging and transportation are considerably lowered, since water contents of the product is minimized the volume of the commercialized product is then significantly reduced. Also, water contents reduction makes possible lessening, or even eliminate, the necessity for preservatives, since the low water contents of concentrated products makes usually them an inadequate media for microorganism growth.

The suitable dilutable concentrated products are those products characterized by a set of features which enable the final consumer their practical use. Among said features, the unwavering one is having the appropriate viscosity/concentration profile, i.e. increased viscosity of the diluted forms compared with the concentrated product. The concentrated product shall be homogeneous and low viscous and able to easily incorporate the water when added in order to prepare the diluted product, indeed, ideally, the dilution should be easily prepared by manual shaking. The resulting diluted product shall be also homogeneous while showing high enough viscosity values. A high enough viscosity value is necessary in order the final consumer can handle the product and control the amount of product spread onto the material to be cleaned, which allows control of dosage. However, viscosity shall not rise in excess since too viscous products do not flow easily which makes difficult their use and dosing them.

The use of electrolytes is one of the very well known approaches in the art to obtain dilutable and concentrated surfactant compositions that thicken upon dilution. For instance, WO94/16680 discloses that the ratio of electrolytes to surfactants in aqueous dilution-thickening personal washing composition is sufficient to form a lamellar phase, which enables to obtain a highly concentrated composition having a viscosity which is low enough for processing, packaging and dispensing. Upon the addition of water, these compositions are described to thicken in use.

One of the drawbacks of using electrolytes to obtain highly concentrated dilution-thickening compositions regards to the high amount of electrolyte in the media, which might cause problems from the stability perspective and/or might be inadequate for some applications of the surfactant composition.

In U.S. Pat. No. 5,922,664 aqueous detergent concentrates containing a mixture of two or more surfactants that differ in their respective resistance to electrolytic salting out are described. It is disclosed that, upon dilution, the surfactant system organization is transformed from micellar phase to lamellar phase, and this produces an increase in viscosity such that the diluted concentrate has a viscosity equal to or higher than the viscosity of the original concentrate. However, the viscosity increase is dependent on the surfactant combination that apparently not allows for highly concentrated dilutable compositions.

Thus, the use of regulators and coregulators of the viscosity has been proposed in order to obtain a highly concentrated dilutable composition of satisfactory viscosity.

U.S. Pat. No. 5,057,246 discloses highly concentrated liquid detergent compositions containing at least one anionic surface agent and a regulator of the viscosity of the diluted composition, consisting of at least one surface active agent chosen from the group formed by nonionic, amphoteric and zwitterionic surface agents, in combination with at least one coregulator of viscosity consisting of an acid or its salt in such quantity that it is dissolved in the concentrated composition. The concentrated detergent compositions are capable of being poured, while the surfactant agent and the acid/salt are being chosen so that the viscosity of the diluted composition is controllable and may increase upon dilution relative to the viscosity of the concentrated composition.

Despite the attempts in the art to obtain concentrated dilutable cleaning compositions, still there is the need for compositions which meet all the ideal requirements, namely:

- surfactant composition has a high active the concentrated matter content; and
- is easy to formulate; and
- the compositions are easy to dilute by using simply manual shaking; and
- the diluted composition exhibit a viscosity that is satisfactory to the consumer; and
- the diluted composition exhibit good performance (e.g. foaming properties and cleaning ability).

Additional possible advantages are:

- the use of materials from natural origin means an additional advantage from the perspective of the green profile of the formulations.
- mildness of the components of the surfactant composition increasing skin tolerance is an advantage when the use of the cleaning composition, as is the case in dishwashing, involves the contact with the human skin.
- the possibility of the concentrated compositions to be formulated at both acid and slightly basic pH values

SUMMARY OF THE INVENTION

According to a first aspect the present invention provides a concentrated dilutable cleaning composition comprising:

(a) one or more anionic surfactants (c) one or more non-ionic surfactants comprising one or more polyethoxylated glycerin ester compounds (d) an electrolyte and optionally (b) one or more amphoteric surfactants (e) one or more solvents (f) one or more pH adjuster agents and (g) water up to 100 wt % of the composition;

wherein the total active matter of the composition calculated from the sum of (a), (c), and (b) if present, is from 45 wt % to less than 100 wt %, preferably from 45 wt % to 80 wt %, more preferably from 45 to 60 wt %, even more preferably 47 wt % to 80 wt %, most preferred from 47 wt % to 60 wt %, even most preferred from 50 wt % to 60 wt %, taking as a whole the concentrated composition.

According to a second aspect the present invention provides a diluted cleaning composition prepared upon dilution with water of the concentrated composition.

According to a third aspect the present invention provides a medium diluted cleaning composition with a total active matter from more than 20 to 35 wt % prepared from dilution with water of a concentrated composition according to the invention.

According to a fourth aspect the present invention provides a highly diluted cleaning composition with a total active matter from more than 5 to less than 20 wt % prepared from dilution with water of a concentrated composition according to the invention.

According to a fifth aspect the present invention provides a method to prepare a concentrated dilutable composition according to the invention.

According to a sixth aspect the present invention provides a method to prepare a diluted composition, a medium diluted composition or a highly diluted composition according to the invention.

According to a further aspect, the present invention provides a method of cleaning comprising contacting said surface with a concentrated, a diluted, a medium diluted or a highly diluted cleaning composition as hereinbefore defined.

According to a further aspect, the present invention provides a method of cleaning comprising using a composition according to the invention.

According to an additional aspect the present invention provides a method of manual dishwashing using a composition according to the invention.

The inventors of the present invention have found that the concentrated dilutable cleansing compositions based on the particular ingredients at the particular ratios according to the invention are able to meet all the desirable requirements for concentrated dilutable compositions. The concentrated dilutable composition according to the invention has an active matter content higher than 45 wt %, preferably higher than 47 wt %, most preferred higher than 50 wt %, being easy to formulate, exhibiting homogeneity, stability and a viscosity that is satisfactory to the consumer while being easy to dilute by using simply manual shaking, providing fast enough a diluted, a medium diluted or a highly diluted cleaning composition characterized in:

High stability

A suitable viscosity

Good performance properties (foam properties, dirt cleaning ability) when used for manual dishwashing.

Besides, the concentrated compositions according to the invention comprise materials from natural origin. The components satisfy the consumer needs from the perspective of mildness and skin tolerance when contact with the human skin.

DETAILED DESCRIPTION OF THE INVENTION

The present invention provides a concentrated dilutable cleaning composition, comprising:

(a) one or more anionic surfactants (c) one or more non-ionic surfactants comprising one or more polyethoxylated glycerin ester compounds (d) an electrolyte and optionally (b) one or more amphoteric surfactants (e) one or more solvents (f) one or more pH adjuster agents and (g) water up to 100 wt % of the composition;

wherein the total active matter of the composition calculated from the sum of (a), (c), and (b) if present, is from 45 wt % to less than 100 wt %, preferably from 45 wt % to 80 wt %, more preferably from 45 to 60 wt %, even more preferably 47 wt % to 80 wt %, most preferred from 47 wt % to 60 wt %, taking as a whole the concentrated composition.

The Active Matter

The active matter corresponds to the active matter weight-percent (wt %) calculated from the sum (a)+(c) of the active matter of all anionic surfactants (a) and all non-ionic surfactants (c) in the composition; and if one or more amphoteric surfactants (b) are present, the active matter corresponds to the active matter weight-percent calculated from the sum (a)+(b)+(c) of the active matter of all anionic surfactants (a), all non-ionic surfactants (c) and all amphoteric surfactants (b) in the composition.

The Component (a)

The composition according to the invention comprises a component (a) comprising one or more anionic surfactants. Examples of suitable anionic surfactants according to the invention include, but are not limited to, alkyl ether sulfates, alkyl sulfates, alkyl sulfonate, alkene sulfonate such as sodium alpha-olefin sulfonate, alkyl aryl sulfonates, sulfosuccinates, sulfosuccinamates, N-alkoyl sarcosinates, alkyl phosphates, alkyl ether phosphates, alkyl amino acids, alkyl peptides, alkyoyl taurates, carboxylic acids, acyl and alkyl glutamates, alkyl isethionates, alkyl ether carboxylates, etc introduced in the composition in the acid form or in the form of a salt, for instance in the form of sodium potassium, calcium, magnesium, ammonium, mono-, di-, or tri-ethanolamine salt, etc.

In a preferred embodiment the component (a) comprises one or more compounds of Formula (I):

$$R^1\text{—O—}(CH_2\text{—}CH(R^2)\text{—O})_n(CH_2CH_2O)_m\text{—}SO_3^-\ (A)_{1/z}^{z+} \quad (I)$$

wherein $R^1$ is a linear or branched, saturated or unsaturated alkyl alkenyl chain having from 4 to 30 carbon atoms, $R^2$ is a C1-C3 linear or branched alkyl chain, A is a suitable countercation, n and m are 0 or an integer number between 1 to 30, and wherein the sum of m+n is from 0 to 30, preferably from 1 to 15 z is 1, 2 or 3.

The component (a) preferably consists of one, two or more compounds of Formula (I).

Preferred compounds of Formula I are alkyl(ether)sulphates that can be used alone or in combination with other anionic surfactants.

In formula I, $A^{z+}$ is a suitable countercation. Alkyl(ether) sulfate metal salts of alkyl(ether)sulfates as well as ammonium salts or organic amine salts with alkyl or hydroxyalkyl substituent can be used as component I in the compositions according to the invention.

In formula I, n and m are 0 or an integer number between 1 to 30, and the sum of m+n is from 0 to 30, preferably from 1 to 15. More preferably, m is not higher than 2 and the sum m+n is below 15. Even more preferred m is 0 and n is below 12. Most preferred the compound (a) comprises a mixture of sodium alkyl ether sulfates with m being zero and with n having an average comprised between 0.5 and 7, more preferably n is comprised between 1 and 5.

The preferred compounds of Formula I according to the invention are metal salts of alkyl ether sulfates as well as ammonium salts or organic amine salts with alkyl or hydroxyalkyl substituent $R^1$, wherein $R^1$ is an alkyl chain having between 2 and 14 carbon atoms, with m being zero and n being a value comprised between 1 and 5.

Sodium lauryl ether sulfate (INCI name Sodium Laureth Sulfate) preferably with an average degree of ethoxylation comprised between 1 and 3, is particularly preferred as an anionic surfactant, more preferably between 1 and 2.5, even more preferably between 2 and 2.5.

Examples of commercially available alkyl ether sulfate type anionic surfactants are those with the commercial reference EMAL® 270D, EMAL® 270E (INCI name Sodium Laureth Sulfate) and EMAL® 227 marketed by KAO Chemicals Europe.

The anionic surfactant (a) can be a mixture of two or more anionic surfactants, or a single anionic surfactant such as an alkyl ether sulfate type surfactant. The preferred weight percentage of the anionic surfactant (a) with respect to the total active matter of the composition is 0.1 to 90 wt %, preferably from 20 to 90 wt %, more preferably from 40 to 85 wt % most preferred from 50 to 85 wt %.

The Component (b)

The composition according to the invention optionally but preferably comprises a component (b) which comprises one or more amphoteric surfactants. Amphoteric surfactants include ampholytes and betaines.

In a preferred embodiment the component (b) of the composition according to the invention comprises one or more betaines. Specific examples of betaines are alkyl betaines, alkyl sulphobetaines (sultaines), amidoalkyl betaines, alkyl glycinates, alkyl carboxyglycinates, alkyl amphoacetates, alkyl amphopropionates, alkylamphoglycinates, alkyl amidopropyl betaines and hydroxysultaines. Particularly preferred betaines are alkyl amidopropyl betaines, alkyl amidopropyl hydroxysultaines, alkyl hydroxysultaines and alkyl amphoacetates. Examples of commercially available useful amphoteric surfactants according to the invention are BETADET® HR, BETADET® HR-50K, BETADET® S-20, BETADET® SHR and BETADET® THC-2, all marketed by Kao Chemicals Europe.

In a preferred embodiment of the invention the component b) of the composition according to the invention comprises one or more ampholytes. Specific examples of ampholytes are amine oxides. Suitable amine oxides according to the present invention are amine oxides with a hydrocarbon chain containing between 8 and 18 carbon atoms.

The amine oxides of Formula (II) are especially preferred

Formula (II)

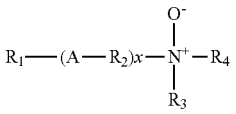

wherein $R_1$ represents a linear or branched, saturated or unsaturated alkyl or alkenyl group containing between 8 and 18 carbon atoms;

$R_2$ represents an alkylene group containing between 1 and 6 carbon atoms;

A represents a group selected from —COO—, CONH—, —OC(O)— and —NHCO—;

x represents 0 or 1;

and $R_3$ and $R_4$ independently of one another represent an alkyl or hydroxyalkyl group containing between 1 and 3 carbon atoms.

The component (b) preferably consists of one, two or more compounds of Formula (II).

According to the invention, in the amine oxides of general Formula (II), $R_1$ is preferably a linear or branched, saturated or unsaturated, alkyl or alkenyl group containing between 10 and 16 carbon atoms, preferably an alkyl or alkenyl group containing between 10 and 14 carbon atoms, more preferably a lauric group (12 carbon atoms) and/or a myristic group (14 carbon atoms).

In a preferred embodiment, in the amine oxides of general formula (II): x is 1, A is a —COO— or —CONH— group, more preferably —CONH—; $R_2$ is also preferably a methylene (—CH2-), ethylene (—CH2-CH2-) group or propylene group (—CH2-CH2-CH2-). $R_3$ and $R_4$ are also preferably each a methyl group.

In another preferred embodiment of the invention, in the amine oxides of general formula (II): x is 0, $R_3$ and $R_4$ each a methyl group and $R_1$ is a lauric group (12 carbon atoms) and/or a myristic group (14 carbon atoms).

In a specially preferred embodiment of the invention the component (b) of the composition according to the invention comprises at least two compounds of Formula (II) being the proportion having $R_1$ $C_{12}$ or $C_{14}$ higher than 60 wt %.

In a very specially preferred embodiment of the invention the component (b) of the composition according to the invention comprises at least two compounds of Formula (II) being the proportion having $R_1$ $C_{12}$ or $C_{14}$ being higher than 60 wt % wherein x is 0.

In another very specially preferred embodiment of the invention the component (b) of the composition according to the invention consists in at least two compounds of Formula (II) being the proportion having $R_1$ $C_{12}$ or $C_{14}$ being higher than 60 wt % wherein x is 0.

Examples of commercially available amine oxides of Formula (II) are those with the commercial reference OXIDET® DM-20 (INCI name Lauramine Oxide), OXIDET® DMCLD (INCI name Cocamine Oxide) OXIDET® DM-246 (INCI name Cocamine Oxide), OXIDET® DM-4 (INCI name Myristamine Oxide), OXIDET® L-75 (INCI name Cocamidopropylamine Oxide), all of them marketed by KAO Chemicals Europe.

The amphoteric surfactant (b) can be a mixture of two or more amphoteric surfactants, or a single amphoteric surfactant. The preferred weight percentage of the amphoteric surfactant (b) with respect to the total active matter of the composition is 0.1 to 65 wt %, preferably from 1 to 65 wt %, more preferably 5 to 40 wt %, most preferred 10 to 30 wt %.

The Component (c)

The composition according to the invention comprises component (c) which comprises one or more polyethoxylated glycerine ester compounds. Preferably, the polyethoxylated glycerine ester composition comprises a mixture of compounds of Formula (IV):

Formula (IV)

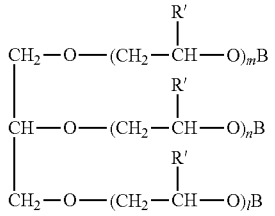

wherein each one of m, n, or l represents, independently, a number of 0 to 200, the sum of m, n and l being in the range of 1 to 200, B being a hydrogen atom or an acyl group represented by —CO—R', R' representing a hydrogen, alkyl or alkenyl group, linear or branched, with 3 to 21 carbon atoms, preferably with 5 to 17 carbon atoms, more preferably with 5 to 11 carbon atoms, wherein the mixture comprises the following compounds i. to iv.:

i. at least one component represented by Formula (IV), wherein, independently, one of the groups B represents an acyl group represented by —CO—R' and the remaining ones represent H ii. at least one component represented by Formula (IV), wherein, independently, two of the groups B represent an acyl group represented by —CO—R' and the remaining one represents H;

iii. at least one component represented by Formula (IV), wherein, independently, each one of the groups B represents an acyl group represented by —CO—R';

iv. at least one component represented by Formula (IV), wherein each one of groups B represents H.

Such mixtures of alkoxylated glycerides and alkoxylated glycerine can be prepared by using the preparation methods as described in the European patent applications EP-A-0579887, EP-A-0586323, EP-A-1045021, and EP-A-2029711B1 and are commercially available under the trademark LEVENOL® and EMANON marketed by Kao Chemicals Europe.

In a preferred embodiment the proportion by weight of the species (i)/(ii)/(iii) is in the range 46-90/9-35/1-15.

In a further preferred embodiment the proportion by weight (i)+(ii)+(iii)/(iv) is in the range of 3.0:0.3 to 0.5:3.0.

In an even more preferred embodiment each one of m, n, or l represents, independently, a number from 0 to 9, the sum of m, n and l being in the range of over 5 and less than 9, characterized in that in the acyl group represented by —CO—R, R represents an alkyl or alkenyl group, linear or branched, of 6 to 9 carbon atoms, and preferably the proportion by weight (i)+(ii)+(iii)/(iv) is in the range of 2.0:0.5 to 0.5:3, more preferably the proportion by weight (i)+(ii)+(iii)/(iv) is in the range of 1.5:0.8 to 0.8:2.5, and preferably the proportion by weight of components (i)/(ii)/(iii) is 60-90/10-35/less than 10.

In addition to the ethoxylated glycerin partial ester the composition according to the invention may comprise other non-ionic cosurfactants. The general definition and general properties of non-ionic surfactants are well-known by the skilled in the art. The definition in "NONIONIC SURFACTANTS—Chemical Analysis" ISBN 0-8247-7626-7 is incorporated herein by reference.

Examples of non-ionic co-surfactants according to the invention include like alkanolamides, alkoxylated alkanolamides, alkoxylated trimethyolol propane, alkoxylated 1,2,3-trihydroxy hexane, alkoxylated pentaetrythritol, alkoxylated sorbitol, alkoxylated glycerol fatty acid partial ester, alkoxylated trimethyolol propane fatty acid ester, alkoxylated 1,2,3-trihydroxy hexane fatty acid ester, alkoxylated pentaetrythritol fatty acid ester, alkoxylated sorbitol fatty acid ester, fatty alcohol, fatty alcohol polyglycol ethers, alkylphenol, alkylphenol polyglycol ethers, fatty acid polyglycol esters, fatty acid amide polyglycol ethers, fatty amine polyglycol ethers, mixed ethers and mixed formals, optionally partly oxidized alk(en)yl oligoglycosides or glucuronic acid derivatives, fatty acid-N-alkylglucamides, ethoxylated glucamine derivatives, protein hydrolyzates (particularly wheat-based vegetable products), polyol fatty acid esters, sugar esters, alkyl polyglucosides, sorbitan esters and polysorbates, Cocamide MEA, Cocamide DEA, PEG-4 Rapeseedamide, Trideceth-2 Carboxamide MEA, PEG-5 Cocamide, PEG-6 Cocamide and PEG-14 Cocamide. Examples of commercially available useful non-ionic surfactants according to the invention are AMIDET® N, AMIDET® A15, AMIDET® A/17, AMIDET® A/26, AMIDET® A-111-P, AMIDET® B-112, LEVENOL® H&B, LEVENOL® C-241, LEVENOL® C-301 and LEVENOL® C-201, LEVENOL F200, EMANON XLF, MYDOL®-10, KALCOL, KAOPAN, RHEODOL and FINDET 10/15 (Polyoxyethylene(3) alkyl(C8-12) ethers), FINDET 10/18 (Polyoxyethylene(6) alkyl(C8-12) ethers), FINDET 1214N/14 (Polyoxyethylene(2) alkyl(C12-14) ethers), FINDET 1214N/15 (Polyoxyethylene(3) alkyl(C12-14) ethers), FINDET 1214N/16 (Polyoxyethylene(2) alkyl(C12-14) ethers), FINDET 1214N/19 (Polyoxyethylene(7) alkyl (C12-14) ethers), FINDET 1214N/21 (Polyoxyethylene(9) alkyl(C12-14) ethers), FINDET 1214N/23 (Polyoxyethylene (11) alkyl(C12-14) ethers), FINDET 13/17 (Polyoxyethylene (5) isotridecyl alcohol), FINDET 13/18.5 (Polyoxyethylene (6.5) isotridecyl alcohol), FINDET 13/21 (Polyoxyethylene (9) isotridecyl alcohol), FINDET 16/36 (Polyoxyethylene (24) alkyl(C16) ethers), FINDET 1618A/18 (Polyoxyethylene(6) alkyl(C16-18) ethers), FINDET 1618A/20 (Polyoxyethylene(8) alkyl(C16-18) ethers), FINDET 1618A/23 (Polyoxyethylene(11) alkyl(C16-18) ethers), FINDET 1618A/35-P (Polyoxyethylene(23) alkyl(C16-18) ethers), FINDET 1618A/52 (Polyoxyethylene(40) alkyl(C16-18) ethers), FINDET 1618A/72-P (Polyoxyethylene(60) alkyl (C16-18) ethers), FINDET 18/27 (Polyoxyethylene(15) alkyl (C18) ethers), FINDET 1816/14 (Polyoxyethylene(1.9) alkyl (C16-18 and C18-unsaturated) ethers), FINDET 1816/18 (Polyoxyethylene(6) alkyl(C16-18 and C18-unsaturated) ethers), FINDET 1816/3220 (Polyoxyethylene(20) alkyl (C16-18 and C18-unsaturated) ethers), FINDET 1816/32-E (Polyoxyethylene(20) alkyl(C16-18 and C18-unsaturated) ethers), FINDET AR/30 (Polyoxyethylene (18) castor oil), FINDET AR-45 (Polyoxyethylene (33) castor oil), FINDET AR-52 (Polyoxyethylene (40) Hydrogenated castor oil), FINDET ARH-52 (Polyoxyethylene (40) castor oil), FINDET K-060 (Polyoxyethylene Coconut monoethanolamide), FINDET LI/1990 (Polyoxyethylene (7) fatty branched alcohol), FINDET LN/8750 (Polyoxyethylene (75) lanolin), FINDET LR4/2585 (Polyoxyethylene (13) fatty branched alcohol), FINDET OR/16 (Polyoxyethylene (4 EO) unsaturated fatty acid), FINDET OR/22 (Polyoxyethylene (10) unsaturated fatty acid), FINDET OR/25 (Polyoxyethylene (13) unsaturated fatty acid), FINDET ORD/17.4 (Polyoxyethylene (5,4) unsaturated fatty acid), FINDET ORD/32 (Polyoxyethylene (20) unsaturated fatty acid), FINDET PG68/52-P (Polyoxyethylene(40) alkyl(C16-18) ethers), FINDET SE-2411 (Polyoxyethylene and polyoxypropylene decyl alcohol), (cetyl alcohol), (Octyl alcohol), KALCOL 1098 (Decyl alcohol), KALCOL 200GD (Octyl dodecanol), KALCOL 0880 KALCOL 2098 (Lauryl alcohol), KALCOL 220-80 (Behenyl alcohol), KALCOL 2450 (Alcohol $C_{10-18}$), KALCOL 2455

(Alcohol $C_{10-18}$), KALCOL 2463 (Alcohol $C_{10-18}$), KALCOL 2470 (Alcohol $C_{12-16}$), KALCOL 2473 (Alcohol $C_{12-16}$), KALCOL 2474 (Alcohol $C_{12-14}$), KALCOL 2475 (Alcohol $C_{12-14}$), KALCOL 4098 (Myristyl alcohol), KALCOL 4250 (Alcohol $C_{12-16}$), KALCOL 6098 (Cetyl Alcohol), KALCOL 6850 (Alcohol $C_{14-18}$), KALCOL 6850 P (Alcohol $C_{14-18}$), KALCOL 6870 (Alcohol $C_{14-18}$), KALCOL 6870 P (Alcohol $C_{14-18}$), KALCOL 8098 (Stearyl alcohol), KALCOL 8665 (Alcohol $C_{16-18}$), KALCOL 8688, FARMIN CS (Coconut amine), FARMIN 08D (Octyl amine), FARMIN 20D (Lauryl amine), FARMIN 80 (Stearyl amine), FARMIN 86T (Stearyl amine), FARMIN O (Oleyl amine), FARMIN T (Tallow amine), FARMIN D86 (Distearyl amine), FARMIN DM24C (Dimethyl coconut amine), FARMIN DM0898 (Dimethyl octyl amine), FARMIN DM1098 (Dimethyl decyl amine), FARMIN DM2098 (Dimethyl lauryl amine), FARMIN DM2463 (Dimethyl lauryl amine), FARMIN DM2458 (Dimethyl lauryl amine), FARMIN DM4098 (Dimethyl myristyl amine), FARMIN DM4662 (Dimethyl myristyl amine), FARMIN DM6098 (Dimethyl palmityl amine), FARMIN DM6875 (Dimethyl palmityl amine), FARMIN DM8680 (Dimethyl stearyl amine), FARMIN DM8098 (Dimethyl stearyl amine), FARMIN DM2285 (Dimethyl behenyl amine), FARMIN M2-2095 (Didodecyl monomethyl amine), DIAMIN R-86 (Hydrogenated tallow propylene diamine), DIAMIN RRT (Tallow propylene diamine), FATTY AMIDE S (Stearamide), FATTY AMIDE T (Stearamide), AMIET 102 (Polyoxyethylene alkyl amine), AMIET 105 (Polyoxyethylene alkyl amine), AMIET 105A (Polyoxyethylene alkyl amine), AMIET 302 (Polyoxyethylene alkyl amine), AMIET 320 (Polyoxyethylene alkyl amine), AMIET TD/23 (Polyoxyethylene(11) Tallow amine), AMIET OD/14 (Polyoxyethylene(2) oleyl amine), AMINON PK-02S (Alkyl alkanolamide), AMINON L-02 (Alkyl alkanolamide), AMIDET A-15 (Fatty acid monoethanolamide), AMIDET A111 (Coconut oil fatty acid ethanolamide), AMIDET B-112 (Coconut oil fatty acid diethanolamide), AMIDET B-120 (Linolenic acid diethanolamide), AMIDET KDE (Coconut oil fatty acid diethanolamide), AMIDET SB-13 (Coconut oil fatty acid diethanolamide), FINDET K-060 (Polyoxyethylene Coconut monoethanolamide, marketed by Kao Chemicals Europe and Kao Corporation.

The non-ionic surfactant (c) can be a mixture of two or more non-ionic surfactants, or a single non-ionic surfactant. The preferred weight percentage of the non-ionic surfactant (c) with respect to the total active matter of the composition is from 0.1 to 90 wt %, preferably from 1 to 80 wt %, more preferably from 5 to 30 wt %, most preferred from 5 to 20 wt %.

The Component (d)

It is well known in the art that electrolytes are able to interact with surfactants in aqueous solution modifying the aggregation form of said surfactants leading thus to viscosity curves with surfactant concentration different to that observed in the absence of the electrolyte. The effects of electrolytes in this regard are usually interpreted in terms of their interactions with the structure of the micelle solution, the interactions between surfactants cylindrical aggregates, the transition between different surfactants lamellar phases, electrostatic interactions between ions and micelles, ionic hydratability and changes in the water structure. In general, it is known that the presence of the electrolyte in the diluted composition causes the development of more viscous surfactant phases, frequently the viscosity enhancement being the consequence of the reorganization of micellar phases (relatively low viscous) to the development of more viscous lamellar phases, which consist in certain arrangement of cylindrical aggregates of the surfactants.

The composition according to the invention comprises a component (d) comprising one electrolyte. Electrolytes according to the invention comprise both inorganic and/or organic electrolytes.

Suitable organic electrolytes according to the invention include short chain organic acid metal salts like citrates, acetates, lactates, oxalates, and the like and mixtures thereof. Suitable inorganic electrolytes include metalsulphates, chlorides, fluorides, iodides, sulphates, phosphates, nitrates, carbonates, hydrogencarbonates like those of sodium, potassium, calcium, magnesium and the like, and mixtures thereof.

In a preferred embodiment the composition according to the invention comprises an electrolyte comprising sodium chloride and/or magnesium chloride, more preferably magnesium chloride.

The electrolyte (d) can be a mixture of two or more electrolytes, or a single electrolyte. The preferred weight percentage of the electrolyte (d) with respect to the total weight of the composition is 1.5 to 8 wt %, more preferably 2 to 6 wt %.

The Component (e)

The composition according to the invention optionally comprises a component (e) comprising one or more solvents. Solvents can contribute to both the stability of the formulation and as improvers of the cleaning ability of the compositions according to the invention.

Examples of suitable solvents according to the invention are hydrocarbons (aromatic or aliphatic), halogenated hydrocarbons like chlorinated hydrocarbons, ether compounds, ketone compounds, aldehyde compounds, and mixtures thereof.

In a preferred embodiment the component (e) comprises one or more alkanols. Examples of alkanols according to the invention are methanol, ethanol, isopropanol, propanol.

In another embodiment of the invention the component (e) comprises ethers and glycols. Examples of suitable ethers and glycols according to the invention include mono and di alkyl ethers of alkylene glycols, dialkylene glycols, trialkylene glycols, polyglycols, propylene glycol, polyethylene glycol, polypropylene glycol, diethylene glycol monoethyl ether, diethylene glycol monopropyl ether, diethylene glycol monobutyl ether, and triethyleneglycol.

The solvent (e) can be a mixture of two or more solvents, or a single solvent. The preferred weight percentage of the solvent (e) with respect to the total weight of the composition is 5 to 15 wt %, more preferably 6 to 12 wt %.

The Component (f)

In a preferred embodiment the composition according to the invention comprises a component (f) comprising a pH adjuster. The amount of pH adjuster added to the composition of the invention will be determined by the composition of the invention and the target pH.

Examples of suitable pH adjusters according to the invention are inorganic acids like hydrogen chloride acid and the like or organic acids like lactic acid and the like, inorganic bases like sodium carbonate, and organic bases and mixtures thereof.

In one embodiment of the invention the pH adjuster comprises an organic acid. Organic acids include, but are not limited to, formic acid, acetic acid, propanoic acid, propionic acid, glycolic acid, sorbic acid, oxalic acid, maleic acid, tartaric acid, adipic acid, lactic acid, malic acid, malonic acid and mixtures thereof.

In a preferred embodiment the pH adjuster comprises lactic acid.

The pH adjuster (f) can be a mixture of two or more pH adjusters, or a single pH adjuster. The preferred weight percentage of the pH adjuster (f) with respect to the total weight of the composition is up to 2 wt %, more preferably 0.5 to 1.5 wt %.

The Composition According to the Invention

According to a first aspect the present invention provides a concentrated dilutable cleaning composition, comprising:

(a) one or more anionic surfactants (c) one or more non-ionic surfactants comprising one or more polyethoxylated glycerin ester compounds (d) an electrolyte and optionally (b) one or more amphoteric surfactants (e) one or more solvents (f) one or more pH adjuster agents and (g) water up to 100 wt % of the composition;

wherein the total active matter of the composition calculated from the sum of (a), (c), and (b) if present, is from 45 wt % to less than 100 wt %, preferably from 45 wt % to 80 wt %, more preferably from 45 to 60 wt %, even more preferably 47 wt % to 80 wt %, most preferred from 47 wt % to 60 wt %, even most preferred from 50 wt % to 60 wt %, and more preferred from 60 wt % to less than 100 wt % when (b) is not present, and even more preferred from 70 wt % to less than 100 wt % when (b) is not present, taking as a whole the concentrated composition.

In one embodiment of the invention the composition of the present invention preferably consists of components (a), (c), (d), and (g) optionally together with component (e) and/or (f).

In a preferred embodiment of the invention the composition of the present invention preferably consists of components (a) to (d), and (g) optionally together with component (e) and/or (f).

In a specially preferred embodiment the composition according to the invention comprises (a), optionally (b), (c), (d), (e), (f) and (g), wherein are:

(a) is one or more compounds of Formula (I):

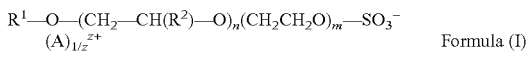

Formula (I)

wherein $R^1$ is a linear or branched, saturated or unsaturated alkyl alkenyl chain having from 4 to 30 carbon atoms, $R^2$ is a C1-C3 linear or branched alkyl chain, A is a suitable countercation, n and m are 0 or an integer number between 1 to 30, and wherein the sum of m+n is from 0 to 30, preferably from 1 to 15 z is 1, 2 or 3.

(a) which is optionally present, is one or more amphoteric surfactants, preferably one or more amine oxides or one or more betaines (b) is one or more non-ionic surfactants comprising one or more polyethoxylated glycerine ester compounds, preferably, the polyethoxylated glycerine ester composition comprising a mixture of compounds of Formula (IV):

Formula (IV)

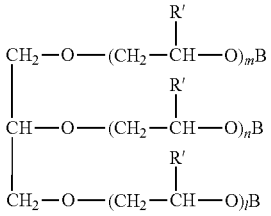

wherein each one of m, n, or l represents, independently, a number of 0 to 200, the sum of m, n and l being in the range of 1 to 200, B being a hydrogen atom or an acyl group represented by —CO—R', R' representing a hydrogen, alkyl or alkenyl group, linear or branched, with 3 to 21 carbon atoms, preferably with 5 to 17 carbon atoms, more preferably with 5 to 11 carbon atoms, wherein the mixture comprises the following compounds i. to iv.:

i. at least one component represented by Formula (IV), wherein, independently, one of the groups B represents an acyl group represented by —CO—R' and the remaining ones represent H;

ii. at least one component represented by Formula (IV), wherein, independently, two of the groups B represent an acyl group represented by —CO—R' and the remaining one represents H;

iii. at least one component represented by Formula (IV), wherein, independently, each one of the groups B represents an acyl group represented by —CO—R';

iv. at least one component represented by Formula (IV), wherein each one of groups B represents H.

(a) is one or more electrolytes (b) is one or more solvents (c) is one or more pH adjuster agents (d) is water up to 100 wt %, wherein the total active matter of the composition calculated from the sum of (a), (b) if present, and (c) is from 45 wt % to less than 100 wt %, preferably from 48 wt % to 80 wt %, most preferred from 50 wt % to 60 wt % taking as a whole the concentrated composition.

In a further specially preferred embodiment the composition according to the invention comprises (a), (c), (d), and (g) optionally together with component (b) and/or (e) and/or (f), wherein (a) is lauryl ether sulfate or a salt thereof (b) which is optionally present, is one or more amphoteric surfactants, preferably one or more amine oxides or one or more betaines (c) is one or more non-ionic surfactants comprising one or more polyethoxylated glycerine ester compounds, preferably, the polyethoxylated glycerine ester composition comprising a mixture of compounds of Formula (IV):

Formula (IV)

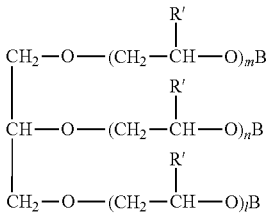

wherein each one of m, n, or l represents, independently, a number of 0 to 200, the sum of m, n and l being in the range of 1 to 200, B being a hydrogen atom or an acyl group represented by —CO—R', R' representing a hydrogen, alkyl or alkenyl group, linear or branched, with 3 to 21 carbon atoms, preferably with 5 to 17 carbon atoms, more preferably with 5 to 11 carbon atoms, wherein the mixture comprises the following compounds i. to iv.:

i. at least one component represented by Formula (IV), wherein, independently, one of the groups B represents an acyl group represented by —CO—R' and the remaining ones represent H ii. at least one component represented by Formula (IV), wherein, independently, two of the groups B represent an acyl group represented by —CO—R' and the remaining one represents H;

iii. at least one component represented by Formula (IV), wherein, independently, each one of the groups B represents an acyl group represented by —CO—R';

iv. at least one component represented by Formula (IV), wherein each one of groups B represents H.

(a) is one or more electrolytes (b) which is optionally present, is one or more solvents (c) which is optionally present, is one or more pH adjuster agents (d) is water up to 100 wt %, wherein the total active matter of the composition calculated from the sum of (a), (c), and (b) if present, is from 45 wt % to less than 100 wt %, preferably from 45 wt % to 80 wt %, more preferably from 45 to 60 wt %, even more preferably 47 wt % to 80 wt %, most preferred from 47 wt % to 60 wt %, even most preferred from 50 wt % to 60 wt %, and more preferred from 60 wt % to less than 100 wt % when (b) is not present, and even more preferred from 70 wt % to less than 100 wt % when (b) is not present, taking as a whole the concentrated composition.

In a preferred embodiment of the invention the composition contains component (a), (c), and optionally (b), in the following content with respect to the total active matter:

(a) is from 0.1 to 90 wt %, preferably from 20 to 90 wt %, more preferably from 40 to 85 wt % most preferred from 50 to 85 wt %, (c) is from 0.1 to 90 wt %, preferably from 1 to 80 wt %, more preferably from 5 to 30 wt %, most preferred from 5 to 20 wt %, (b) if present, is from 0.1 to 65 wt %, preferably from 1 to 65 wt %, more preferably 5 to 40 wt %, most preferred 10 to 30 wt %.

In a preferred embodiment the total amount of component (d) calculated taking as a whole the concentrated formula is from 0.1 to 20 wt %, preferably from 0.5 to 15 wt %.

In a preferred embodiment the pH of concentrated composition according to the invention is between 2.5 to 8.5.

In one embodiment of the invention the pH of the concentrated composition according to the invention is between 2 to 6, more preferably from 3 to 5.

According to the present invention, preferred embodiments may be combined to provide even more preferred embodiments. For example, a particularly preferred embodiment of component (a) may be combined with a particularly preferred embodiment of component (c), and/or (d), and/or (e), and/or (f); a particularly preferred embodiment of component (a) may be combined with a particularly preferred embodiment of component (b), and/or (c), and/or (d), and/or (e), and/or (f); a particularly preferred embodiment of component (b) may be combined with a particularly preferred embodiment of component (a), and/or (c), and/or (d), and/or (e), and/or (f); a particularly preferred embodiment of component (c) may be combined with a particularly preferred embodiment of component (a), and/or (d), and/or (e), and/or (f); a particularly preferred embodiment of component (c) may be combined with a particularly preferred embodiment of component (a), and/or (b), and/or (d), and/or (e), and/or (f); a particularly preferred embodiment of component (d) may be combined with a particularly preferred embodiment of component (a), and/or (c), and/or (e), and/or (f); a particularly preferred embodiment of component (d) may be combined with a particularly preferred embodiment of component (a), and/or (b), and/or (c), and/or (e), and/or (f); a particularly preferred embodiment of component (e) may be combined with a particularly preferred embodiment of component (a), and/or (c), and/or (d), and/or (f); a particularly preferred embodiment of component (e) may be combined with a particularly preferred embodiment of component (a), and/or (b), and/or (c), and/or (d), and/or (f); a particularly preferred embodiment of component (f) may be combined with a particularly preferred embodiment of component (a), and/or (c), and/or (d), and/or (e) and a particularly preferred embodiment of component (f) may be combined with a particularly preferred embodiment of component (a), and/or (b), and/or (c), and/or (d), and/or (e).

In a preferred embodiment, the concentrated dilutable cleaning composition according to the invention has a viscosity at 20° C. which is a viscosity below 500 cps, preferably below 300 cps, and more preferably below 250 cps.

According to a second aspect the present invention provides a diluted cleaning composition prepared upon dilution with water of the concentrated composition according to the invention.

According to a third aspect the present invention provides a medium diluted cleaning composition with a total active matter from more than 20 to 35 wt % prepared from dilution with water of a concentrated composition according to the invention.

In a preferred embodiment, the medium diluted cleaning composition with a total active matter from more than 20 to 35 wt % according to the invention has a viscosity at 20° C. which is a viscosity in the range of 300 cps to 3500 cps, preferably in the range of 500 cps to 3000 cps, more preferably in the range of 600 cps to 2000 cps.

According to a fourth aspect the present invention provides a highly diluted cleaning composition with a total active matter from more than 5 to less than 20 wt % prepared from dilution with water of a concentrated composition according to the invention.

In a preferred embodiment, the highly diluted cleaning composition with a total active matter from more than 5 to less than 20 wt % according to the invention has a viscosity at 20° C. which is a viscosity in the range of 200 cps to 3500 cps, preferably in the range of 300 cps to 2000 cps, more preferably in the range of 400 cps to 1200 cps.

In one preferred embodiment the concentrated composition according to the invention has a pH in the range of 6 to 14, preferably in the range of 6 to 8.

In another preferred embodiment the concentrated composition according to the invention has a pH in the range of 2 to less than 6.

In one preferred embodiment the diluted cleaning composition has a pH in the range of 6 to 14, preferably in the range of 6 to 8.

In another preferred embodiment the diluted cleaning composition has a pH in the range of 2 to less than 6.

In one preferred embodiment the medium diluted cleaning composition has a pH in the range of 6 to 14, preferably in the range of 6 to 8.

In another preferred embodiment the medium diluted cleaning composition has a pH in the range of 2 to less than 6.

In one preferred embodiment the highly diluted cleaning composition has a pH in the range of 6 to 14, preferably in the range of 6 to 8.

In another preferred embodiment the highly diluted cleaning composition has a pH in the range of 2 to less than 6.

According to a fifth aspect the present invention provides a cleaning composition with a controlled viscosity profile that is satisfactory for the consumer, and wherein the concentrated dilutable cleaning composition according to the invention has a viscosity at 20° C., which is a low viscosity that is in a range which is usable for the consumer, and wherein the medium diluted cleaning composition obtained upon diluting the concentrated cleaning composition has a higher viscosity than the concentrate and which is a viscosity that is controlled to be in a range which is satisfactory for the consumer; and wherein the highly diluted cleaning composition obtained upon diluting the concentrated cleaning composition and/or the medium diluted cleaning composition has a maintained high or reduced viscosity with respect to the medium diluted cleaning composition which is a viscosity that is controlled to be in a range which is satisfactory for the consumer, preferably in the range of 200 cps-3500 cps.

In a preferred embodiment, the present invention provides a cleaning composition with a viscosity profile that is satisfactory for the consumer, and wherein the concentrated dilutable cleaning composition according to the invention has a viscosity at 20° C., which is a viscosity below 500 cps, preferably below 300 cps, more preferably below 250 cps; and wherein the medium diluted cleaning composition obtained upon diluting the concentrated cleaning composition has a total active matter from more than 20 to 35 wt %, and wherein the medium diluted cleaning composition has a viscosity at 20° C. which is a viscosity in the range of 300 to 3500 cps, preferably in the range of 500 cps to 3000 cps, more preferably in the range from 600 to 2000 cps; and wherein the highly diluted cleaning composition obtained upon diluting the concentrated cleaning composition and/or the medium diluted cleaning composition has a total active matter from more than 5 to 20 wt %, and wherein the highly diluted cleaning composition has a viscosity at 20° C. which is a viscosity in the range of 200 cps to 3500 cps, preferably in the range of 300 cps to 2000 cps, more preferably in the range from 400 to 1200 cps.

According to a sixth aspect the present invention provides a method to prepare a concentrated dilutable composition according to the invention.

According to a seventh aspect the present invention provides a method to prepare a diluted composition, a medium diluted composition or a highly diluted composition according to the invention.

In another aspect, the present invention provides a method to prepare a concentrated, a diluted, a medium diluted or a highly diluted cleaning composition according to the invention as hereinabove defined.

The concentrated dilutable compositions according to the invention can be prepared by dissolving the components (a), (c) and (d) and optionally (b), (e) and (f) in water, preferably under stirring and heating.

The diluted composition is preferably prepared by diluting the concentrated composition with water such as tap water; the medium diluted composition is preferably prepared by diluting the concentrated or a diluted composition with water such as tap water, the highly diluted composition is preferably prepared by diluting the concentrated or a diluted or medium diluted composition with water such as tap water.

A Cleaning Method According to the Invention

According to a further aspect, the present invention provides a method of cleaning comprising contacting said surface with a concentrated, a diluted, a medium diluted or a highly diluted cleaning composition as hereinbefore defined.

According to a further aspect, the present invention provides a method of cleaning comprising using a composition according to the invention.

According to an additional aspect the present invention provides a method of manual dishwashing using a composition according to the invention.

The compositions according to the invention are especially suitable for manual dishwashing although the compositions according to the invention could be used for hard surface cleaning or cleaning in general. The compositions according to the invention might be directly applied to the treated surface or could be used by being applied in a sponge, towel or other porous or any meshed suitable device.

According to a further additional aspect the present invention provides a foam generated from a dilution and mixture with air of a composition according to the invention.

Preferably the method to generate a foam cleaner using a composition according to the invention comprises the steps herein below defined. To apply the composition according to the invention over a surface a suitable foam generator device is used. The dilution of the composition according to the invention can be made prior to use or at the very moment of the application, meaning that the foaming generator device might includes a system that allows the composition according to the invention to be introduced at relatively high concentration and to be diluted to the suitable concentration for foam generation. Usually the foam generator device delivers the foam to a container and the foam is pumped to and put in contact with the surface to be treated.

Additives to the Composition According to the Invention

The composition according to the invention can comprise other components aimed to improve any technical aspect of the composition like the stability, the cleaning ability or the sensorial aspects related to the consumer perception.

Cationic Surfactants

Examples of cationic surfactants are alkyl benzyl dimethyl ammonium halides, alkyl trimethyl ammonium halides, alkyl hydroxyethyl ammonium halides, quaternized ethoxylated amines, esterquats derived from triethanolamine, methyldiethanolamine, dimethylaminopropanediol, oligomers of said esterquats and the like and mixtures thereof.

Disinfecting Agents

The cleaning composition according to the invention can comprise disinfecting agents in order to improve the disinfection ability of the surfaces to be treated. Suitable disinfecting agents according to the invention include any organic or inorganic compounds with antimicrobial activity. Examples of suitable antimicrobial agents according to the invention are phenols and derivatives; organic and inorganic acids, their esters and salts (acetic acid, propionic acid, undecanoic acid, sorbic acid, lactic acid, benzoic acid, salicylic acid, dehydroacetic acid, sulphur dioxide, sulphites, bisulphites); alcohols (ethanol, isopropanol, n-propanol, methanol, benzyl alcohol, etc) and peroxides (hydrogen peroxide, peracetic acid, benzoyl peroxide, sodium perborate, potasium permanganate, etc.), aldehydes (formaldehyde, glutaraldehyde, glyoxal); quaternary ammonium compounds-quats (benzalconium chloride, cetylpiridinium chloride, didecyldimethylammonium chloride, etc); chlorine based derivatives such as chloramines, dichloroisocianurates, chloroform and chlorine releasing compounds (i.e: sodium hypochlorite); Iodine based compounds (free iodine, iodophors and iodoform); metals and salts (cadmium, silver, copper, etc). The selection of the suitable disinfecting agent can be made by the skilled in the art taking into consideration the specific characteristics of the target use of the composition according to the invention.

Sequestering/Chelating Agents of the Invention

The cleaning composition according to the invention can comprise organic or inorganic substance which could contribute to pH adjustment though main purpose is to contain the effects of water hardness on surfactants activity detriment. Examples of sequestering/chelating agents suitable for the composition according to the invention include hydroxides, carbonates, bicarbonates, silicates, borates, zeolites, citrates, polycarboxylates, EDTA, nitrilotriacetate, phosphonic acid, phosphonic acid derivatives, for instance those commercialized under the brandname DEQUEST available from Monsanto, phosphates and complex phosphates like polyphosphates and the like, and mixtures thereof.

Preservatives

The composition according to the invention can comprise certain amounts of preservatives or biocides in order to prevent biological degradations at certain conditions. Examples of suitable preservatives for the composition according to the invention include 1,2-benzisothiazol-3-one; Benzyl alcohol; 5-bromo-5-nitro-1,3-dioxane; 2-bromo-2-nitropropane-1,3-diol; Chloroacetamide; Diazolinidylurea; Formaldehyde; Glutaraldehyde; Guanidine, hexamethylene-, homopolymer; CMI+MIT in mixture 3:1 [5-chloro-2-methyl-4-isothiazolin-3-one]+[2-methyl-4-isothiazolin-3-one]; 2-methyl-2H-isothiazol-3-one (MIT); Methyldibromoglutaronitrile; e-phtaloimidoperoxyhexanoic acid; methyl-, ethyl- and propylparaben; o-phenylphenol; sodium benzoate; sodium hydroxy methyl glycinate; sodium nitrite; triclosan; phenoxy-ethanol.

Perfumes, Colorant, Dyes or Other Sensorial Improvers

The composition according to the invention might contain certain amounts of perfumes, fragrances, colorants or dyes or other components intended to improve its appearance or the sensorial experience of the user of the composition or intended to solve some practical matter like to enable the visual detection of the presence of the composition according to the invention.

Examples of suitable fragrances according to the invention include aldehydes, esters, ketones and the like.

The aldehydes useful in the present invention can be one or more of, but not limited to, the following group of aldehydes: phenylacetaldehyde, p-methyl phenylacetaldehyde, p-isopropyl phenylacetaldehyde, methylnonyl acetaldehyde, phenylpropanal, 3-(4-t-butylphenyl)-2-methyl propanal, 3-(4-t-butylphenyl)-propanal, 3-(4-methoxyphenyl)-2-methylpropanal, 3-(4-isopropylphenyl)-2-methylpropanal, 3-(3,4-methylenedioxyphenyl)-2-methylpropanal, 3-(4-ethylphenyl)-2,2-dimethylpropanal, phenylbutanal, 3-methyl-5-phenylpentanal, hexanal, trans-2-hexenal, cis-hex-3-enal, heptanal, cis-4-heptenal, 2-ethyl-2-heptenal, 2,6-dimethyl-5-heptenal (melonal), 2,6-dimethylpropanal, 2,4-heptadienal, octanal, 2-octenal, 3,7-dimethyloctanal, 3,7-dimethyl-2,6-octadien-1-al, 3,7-dimethyl-1,6-octadien-3-al, 3,7-dimethyl-6-octenal, 3,7-dimethyl-7-hydroxyoctan-1-al, nonanal, 6-nonenal, 2,4-nonadienal, 2,6-nonadienal, decanal, 2-methyl decanal, 4-decenal, 9-decenal, 2,4-decadienal, undecanal, 2-methyldecanal, 2-methylundecanal, 2,6,10-trimethyl-9-undecenal, undec-10-enyl aldehyde, undec-8-enanal, dodecanal, tridecanal, tetradecanal, anisaldehyde, bourgenonal, cinnamic aldehyde, α-amylcinnam-aldehyde, α-hexyl cinnamaldehyde, methoxy cinnamaldehyde, citronellal, hydroxy-citronellal, isocyclocitral, citronellyl oxyacet-aldehyde, cortexaldehyde, cumminic aldehyde, cyclamem aldehyde, florhydral, heliotropin, hydrotropic aldehyde, lilial, vanillin, ethyl vanillin, benzaldehyde, p-methyl benzaldehyde, 3,4-dimethoxybenzaldehyde, 3- and 4-(4-hydroxy-4-methyl-pentyl)-3-cyclohexene-1-caroxaldehyde, 2,4-dimethyl-3-cyclohexene-1-carboxaldehyde, 1-methyl-3-4-methylpentyl-3-cyclohexencarboxaldehyde, and p-methylphenoxyacetaldehyde.

Examples of ketones useful in the present invention can be one or more of, but not limited to, the group of following ketones: α-damascone, β-damascone, δ-damascone, β-damascenone, muscone, 6,7-dihydro-1,1,2,3,3-pentamethyl-4(5H)-indanone, cashmeran, cis-jasmone, dihydrojasmone, methyl dihydrojasmonate, α-ionone, β-ionone, dihydro-β-ionone, γ-methyl ionone, α-iso-methyl ionone, 4-(3,4-methylenedioxyphenyl)butan-2-one, 4-(4-hydroxyphenyl) butan-2-one, methyl β-naphthyl ketone, methyl cedryl ketone, 6-acetyl-1,1,2,4,4,7-hexamethyltetralin (tonalid), 1-carvone, 5-cyclohexadecen-1-one, acetophenone, decatone, 2-[2-(4-methyl-3-cyclohexenyl-1-yl)propyl]cyclopentan-2-one, 2-sec-butylcyclohexanone, β-dihydro ionone, allyl ionone, α-irone, α-cetone, α-irisone, acetanisole, geranyl acetone, 1-(2-methil-5-isopropyl-2-cyclohexenyl)-1-propanone, acetyl diisoamylene, methyl cyclocitrone, 4-t-pentyl cyclohexanone, p-t-butylciclohexanone, o-t-butylcyclohexanone, ethyl amyl ketone, ethyl pentyl ketone, menthone, methyl-7,3-dihydro-2H-1,5-benzodioxepine-3-one, fenchone, methyl naphthyl ketone, propyl naphthyl ketone and methyl hydroxynaphthyl ketone.

Hydrotopes

The composition according to the invention might comprise certain amounts of one ore more hydrotopes intended to enhance the solubility of certain substances. Examples of suitable hydrotopes to be used in the composition according to the invention are p-toluene sulfonates, xylene sulfonates and cumene sulfonates, preferably in the form of their calcium, potassium, sodium or ammonium salts.

If the compositions according to the invention are used for manual dishwashing, preferable additives can be selected from the list above. However, the compositions according to the invention could be used in different applications. In this regard, the suitable additives could include also other components like corrosion inhibitors, polymers, natural oils, silicones, fluorescent whitening agents, photo-bleaches, fiber lubricants, reducing agents, enzymes, enzyme stabilizing agents, powder finishing agents, builders, bleaches, bleach catalysts, soil release agents, dye transfer inhibitors, buffers, colorants, fragrances, pro-fragrances, rheology modifiers, anti-ashing polymers, soil repellents, water-resistance agents, suspending agents, aesthetic agents, structuring agents, sanitizers, solvents, fabric finishing agents, dye fixatives, fabric conditioning agents, deodorizers, etc.

The following examples are given in order to provide a person skilled in the art with a sufficiently clear and complete explanation of the present invention, but should not be considered as limiting of the essential aspects of its subject, as set out in the preceding portions of this description.

EXPERIMENTAL SECTION

1. Concentrated Dilutable Compositions According to the Invention: Preparation, Dilution and Characteristics Table 1 summarizes the components of the concentrated compositions according to the invention (Examples 1-7) and comparative examples (Comparative Examples 1-7).

Concentrated compositions are prepared at room temperature introducing in a laboratory baker the suitable quantity of each one of the components detailed in the Table 1 in order to have the active matter contents indicated therein. The mixture containing all the components is stirred until complete homogenization. pH is measured in the concentrated formula, as it is, with a CRISON microp H 2001 pH-meter.

Table 2 summarizes the appearance, viscosity, pH and dilution ability characteristics of the concentrated compositions described in Table 1.

The dilution ability is measured during the preparation of the diluted compositions as follows. A suitable quantity of the concentrated composition is introduced in a glass bottle. Then the appropriate amount of water is added to the bottle. The mixture is manually shaken for 20 seconds. Then the mixture is allowed to equilibrate at room temperature. The time needed to observe the diluted composition exhibits a homogeneous aspect, this is without observing gel lumps or foam, is the parameter that characterizes the dilution ability. The lower the time observed the better the dilution ability.

In Table 2, diluted formulations noted as "2×" correspond to medium diluted compositions and are prepared by mixing 1 part per weight of concentrated formula and 1 part by weight of water. Correspondingly, diluted formulations noted as "3×" corresponds to highly diluted compositions and are prepared by mixing 1 part by weight of concentrated formula with 2 parts by weight of water.

Appearance is visually assessed at room temperature, for the concentrated and for the diluted formulas.

Viscosity is measured at 20° C. using a Brookfield LV viscometer, the appropriate spindle type and speed (rpm) combinations (spindle/rpm) are chosen following the instructions of the Brookfield devices. If not indicated otherwise, the viscosity of the concentrated dilutable cleaning compositions is measured with a spindle/speed combination of 1/6 (spindle/rpm) at 20° C., whereas the viscosity of the diluted cleaning compositions including the medium diluted and highly diluted cleaning compositions is measured with a spindle/speed combination of 2/6 (spindle/rpm) at 20° C.

Table 3 summarizes the foaming power (the ability to generate foam) of the different diluted compositions evaluated using a SITA Foam Tester R-2000 (by SITA Messtechnik GmbH). The foaming power is determined for a diluted composition at a concentration of 0.012 active matter wt % prepared using hard water (20° HF (544 ppm $Ca^{2+}$ and 156 ppm $Mg^{2+}$). The reason for doing the test using a composition of that low active matter is to observe the behavior of the composition at similar conditions to those occurring in real hand-dishwashing. The foaming power is evaluated in the absence and in the presence of olive oil. The reason for adding olive oil is to evaluate the foaming power in the present of fats. The foaming power is expressed as the maximum foam volume observed during the test. The test consists in the repetition of 50 cycles each one including the following steps:

Foam Power Measurement without Oil
- Stirring cycle of 10 s at 1500 rpm
- Observation of foam volume Foam Power Measurement with Oil
- Adding 50 μL of olive oil
- Stirring cycle of 10 s at 1500 rpm
- Observation of foam volume The test is carried out at a temperature of 40° C. The purpose of the test is to show the foaming power of the diluted compositions according to the invention is equal or even better to that of comparative examples.

Cleaning ability is assessed using IKW Recommendation for the Quality Assessment of the Cleaning Performance of Hand Dishwashing detergents, published in SÖFW-Journal, 128, Jahrgang 5-2002. Cleaning ability corresponds to the number of cleaned dishes, soiled with IKW soil 1. The cleaning ability of a diluted composition according to the invention and of a commercial product is compared in Table 4. The results show that the performance of the diluted compositions according to invention is good.

TABLE 1

| Concentrated compositions | | | | | | | | |
|---|---|---|---|---|---|---|---|---|
| | [wt %] calculated taking the sum of (a) + (b) + (c) as a whole | | | [wt %] calculated in respect of the total composition | | | | |
| | component (a) (lauryl ether sulfate) | component (b) (amphoteric surfactants) | component (c) (non-ionic surfactant) | component (d) (electrolytes) | component (e) (Ethanol) | component (f) (Citric acid) | Active Matter | pH |
| Example 1 | 60 | 20 (1) | 20 (3) | 4.8 ($MgCl_2$) | 9.6 | 0.5 | 47.9 | 6.5 |
| Example 2 | 70 | 20 (1) | 10 (3) | 3.5 ($MgCl_2$) | 6.5 | 0.5 | 48.4 | 6.1 |
| Example 3 | 75 | 20 (1) | 5 (3) | 1.8 (NaCl) | 10 | 1.5 | 45.1 | 5.5 |
| Example 4 | 80 | 10 (1) | 10 (3) | 5.1 ($MgCl_2$) | 9.1 | 0.5 | 51.3 | 5.9 |
| Example 5 | 70 | 20 (1) | 10 (3) | 3.2 ($MgCl_2$) | 10 | 0.5 | 46.9 | 3.2 |
| Example 6 | 70 | 20 (2) | 10 (4) | 3.5 ($MgCl_2$) | 9.5 | 0.5 | 48.4 | 6.0 |
| Example 7 | 70 | 20 (2) | 10 (4) | 3.2 ($MgCl_2$) | 10 | 0.5 | 46.9 | 3.2 |
| Comparative Example 1 | 70 | 30 (1) | 0 | 2.5 (NaCl) | 10 | 0.5 | 45.6 | 6.5 |
| Comparative Example 2 | 70 | 20 (1) | 10 (5) | 3.5 ($MgCl_2$) | 9.5 | 0.5 | 48.4 | 6.0 |
| Comparative Example 3 | 70 | 20 (1) | 10 (6) | 3.5 ($MgCl_2$) | 9.5 | 0.5 | 47.3 | 6.0 |
| Comparative Example 4 | 70 | 20 (1) | 10 (7) | 3.5 ($MgCl_2$) | 9.5 | 0.5 | 45.7 | 6.1 |
| Comparative Example 5 | 78 | 22 ($b^1$) | 0 | 3.2 ($MgCl_2$) | 10 | 0.5 | 44.7 | 3.1 |
| Comparative Example 6 | 70 | 20 ($b^1$) | 10 (8) | 3.2 ($MgCl_2$) | 10 | 0.5 | 46.9 | 3.2 |

TABLE 1-continued

| Concentrated compositions | | | | | | | | |
|---|---|---|---|---|---|---|---|---|
| | [wt %] calculated taking the sum of (a) + (b) + (c) as a whole | | | [wt %] calculated in respect of the total composition | | | | |
| | component (a) (lauryl ether sulfate) | component (b) (amphoteric surfactants) | component (c) (non-ionic surfactant) | component (d) (electrolytes) | component (e) (Ethanol) | component (f) (Citric acid) | Active Matter | pH |
| Comparative Example 7 | 70 | 20 (b[1]) | 10 (7) | 3.2 ($MgCl_2$) | 10 | 0.5 | 44.3 | 3.0 |

(X) stands for:
(1) cocoamidopropyl amine oxide
(2) cocoamidopropyl betaine
(3) capric/caprylic glycerin ester ethoxylated with 7 EO mols
(4) cocoate glycerin ester ethoxylated with 7 EO mols
(5) $C_{13}/C_{15}$ alcohol ethoxylated with 7 EO mols
(6) $C_8/C_{10}$ alkylpolyglucoside
(7) $C_{12}/C_{14}$ alkylpolyglucoside
(8) $C_9$-$C_{11}$ alcohol ethoxylated with 7 EO mols

TABLE 2

| Properties of the dilutions obtained from the concentrated compositions described in Table 1 | | | | | | | |
|---|---|---|---|---|---|---|---|
| | Concentrated compositions | Medium diluted compositions "2X" | | | Highly diluted compositions "3X" | | |
| | Viscosity [cps] | Active Matter | Viscosity [cps] | Dilution ability [h] | Active Matter | Viscosity (cps) | Dilution ability [h] |
| Example 1 | 143 | 23.9 | 595 | <1 | 16 | 425 | <1 |
| Example 2 | 220 | 24.2 | 1785 | <1 | 16.1 | 950 | <1 |
| Example 3 | 141 | 22.6 | 1980 | <1 | 15.0 | 595 | <1 |
| Example 4 | 184 | 25.7 | 1635 | <1 | 17.1 | 830 | <1 |
| Example 5 | 160 | 23.5 | 1765 | <1 | 15.6 | 815 | <1 |
| Example 6 | 229 | 24.2 | 2974 | <1 | 16.1 | 3214 | <1 |
| Example 7 | 147 | 23.5 | 2895 | <1 | 15.6 | 1590 | <1 |
| Comparative Example 1 | >100000 (*[1]) | 22.8 | 4894 (*[2]) | 24 | 15.2 | 130 (*[3]) | 24 |
| Comparative Example 2 | 242 | 24.2 | 3029 | 2 | 16.1 | 3989 | 2 |
| Comparative Example 3 | 290 | 23.7 | 2245 | 24 | 15.8 | 840 | 24 |
| Comparative Example 4 | 316 | 22.9 | 5279 (*[2]) | 4 | 15.2 | 6139 | 4 |
| Comparative Example 5 | 35 (*[3]) | 22.4 | 7000 (*[2]) | 2 | 14.9 | (**) | (**) |
| Comparative Example 6 | 205 | 23.5 | 3579 | 2 | 15.6 | 3329 | 2 |
| Comparative Example 7 | 248 | 22.2 | 6459 (*[2]) | 2 | 14.8 | 7058 (*[2]) | 2 |

(**) not homogeneous aspect, separate formula
Viscosity measurement at 20° C. carried out with (spindle/rpm) combination of:
(*[1]) used 4/3;
(*[2]) used 3/6;
(*[3]) used 1/6

TABLE 3

| Foaming Power | | |
|---|---|---|
| | Maximum Volume Foam (mL) without oil | Maximum Volume Foam (mL) with oil |
| Example 2 | 465 | 231 |
| Example 4 | 470 | 267 |
| Example 5 | 475 | 277 |
| Example 6 | 447 | 261 |

TABLE 3-continued

| Foaming Power | | |
|---|---|---|
| | Maximum Volume Foam (mL) without oil | Maximum Volume Foam (mL) with oil |
| Comparative Example 2 | 400 | 221 |
| Comparative Example 4 | 440 | 260 |

TABLE 4

| Cleaning Ability | | |
|---|---|---|
| | SITA with oil | IKW1 |
| Example 2 | 231 | 19 |
| Commercial Product (*) | 216 | 17 |

(*) Fairy (Procter&Gamble)

It can be seen that compositions according to the invention provide formulations with suitable viscosity profiles and are more feasible dilutable than comparative examples.

The foaming behavior and the cleaning performance is adequate making the compositions according to the invention suitable for dishwashing.

The invention claimed is:

1. A concentrated dilutable cleaning composition, comprising:

(a) one or more anionic surfactants, wherein the one or more anionic surfactants (a) is lauryl ether sulfate or a salt thereof, (b) one or more amphoteric surfactants selected from the group consisting of amine oxides and betaines, (c) one or more non-ionic surfactants comprising one or more polyethoxylated glycerin ester compounds which is a polyethoxylated glycerine ester composition comprising a mixture of compounds of Formula (IV), wherein Formula (IV) is:

Formula IV

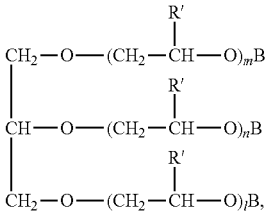

wherein each one of m, n, or 1 represents, independently, a number of 0 to about 200, wherein the sum of m, n and 1 is in the range of about 1 to about 200, wherein B is a hydrogen atom or an acyl group represented by —CO—R', wherein R' represents a hydrogen, an alkyl, or an alkenyl group with 3 to 21 carbon atoms, and wherein the mixture comprises the following compounds i. to iv.:

i. at least one component is represented by Formula (IV), wherein, independently, one of the groups B represents an acyl group represented by —CO—R' and the remaining groups represent H;

ii. at least one component is represented by Formula (IV), wherein, independently, two of the groups B represent an acyl group represented by —CO—R' and the remaining groups represent H;

iii. at least one component is represented by Formula (IV), wherein, independently, each one of the groups B represents an acyl group represented by —CO—R'; and iv. at least one component represented by Formula (IV), wherein each one of groups B represents H, (d) an electrolyte, and optionally (e) one or more solvents, (f) one or more pH adjuster agents, and (g) water up to about 100 wt % of the composition;

wherein the total active matter of the composition calculated from the sum of (a) the one or more anionic surfactants, (c) the one or more non-ionic surfactants, and (b) the one or more amphoteric surfactants is from about 45 wt % to less than 100 wt % taking as a whole the concentrated composition, and wherein the amount of one or more non-ionic surfactants (c) is from 5 to 90 wt % with respect to the total active matter of the composition.

2. The concentrated dilutable cleaning composition according to claim 1 wherein the proportion by weight of the species (i):(ii):(iii) is in the range of about 46 parts to about 90 parts (i), about 9 parts to about 35 parts (ii), and about 1 part to about 15 parts (iii), respectively.

3. The concentrated dilutable cleaning composition according to claim 1 wherein the proportion by weight ((i)+(ii)+(iii)):(iv) is in the range of about 3.0:0.3 to about 0.5:3.0.

4. The concentrated dilutable cleaning composition according to claim 1 wherein each one of m, n, or l represents, independently, a number from 0 to 9, wherein the sum of m, n and l is in the range of greater than 5 and less than 9, wherein the acyl group is represented by —CO—R, wherein R represents an alkyl or an alkenyl group, with 6 to 9 carbon atoms, and wherein the proportion by weight of ((i)+(ii)+(iii)):(iv) is in the range of about 2.0:0.5 to about 0.5:3, and wherein the proportion by weight of (i):(ii):(iii) is about 60 parts to about 90 parts (i):about 10 parts to about 35 parts (ii):less than about 10 parts (iii), respectively.

5. The concentrated dilutable cleaning composition according to claim 1, wherein the electrolyte (d) is sodium chloride or magnesium chloride.

6. The concentrated dilutable cleaning composition according to claim 1, wherein the composition has a viscosity at about 20° C. that is below 500 cps.

7. The concentrated dilutable cleaning composition of claim 1, wherein the composition is diluted to obtain a diluted cleaning composition.

8. The concentrated dilutable cleaning composition of claim 1, wherein the composition is diluted to obtain a medium diluted cleaning composition, wherein the total active matter of the composition is from more than about 20 to about 35 wt %.

9. The concentrated dilutable cleaning composition of claim 8, wherein the composition has a viscosity at about 20° C. that ranges from about 300 to about 3500 cps.

10. The concentrated dilutable cleaning composition of claim 1, wherein the composition is diluted to obtain a highly diluted cleaning composition, and wherein the total active matter of the composition is from more than about 5 to about 20 wt %.

11. The concentrated dilutable cleaning composition of claim 10, wherein the composition has a viscosity at about 20° C. that ranges from about 200 to about 3500 cps.

12. A method to prepare a concentrated dilutable cleaning composition, wherein said method comprises the step of:

diluting the composition of claim 1 to obtain a diluted, a medium diluted or a highly diluted composition.

13. The method according to claim 12, wherein said method further comprising the step of:

dissolving the one or more anionic surfactants (a), the one or more non-ionic surfactants (c), and the electrolyte (d)

and the one or more amphoteric surfactants (b), the one or more solvents (e), and the one or more pH adjuster agents (f) in water.

14. A method of cleaning an object, said method comprising the step of:

contacting a surface of the object with the concentrated dilutable cleaning composition according to claim 1, wherein the contacting results in cleaning the surface of the object.

15. The concentrated dilutable cleaning composition of claim 1, wherein R' has 5 to 17 carbon atoms.

16. The concentrated dilutable cleaning composition of claim 1, wherein R' has 5 to 11 carbon atoms.

* * * * *